United States Patent [19]

Wahle et al.

[11] Patent Number: 4,564,026

[45] Date of Patent: Jan. 14, 1986

[54] METHOD OF AND APPARATUS FOR BUILDING A TOBACCO STREAM

[75] Inventors: Günter Wahle, Reinbek; Dieter Ludszeweit; Uwe Heitmann, both of Hamburg, all of Fed. Rep. of Germany

[73] Assignee: Hauni-Werke Körber & Co. KG, Hamburg, Fed. Rep. of Germany

[21] Appl. No.: 557,735

[22] Filed: Dec. 2, 1983

[30] Foreign Application Priority Data

Dec. 2, 1982 [DE] Fed. Rep. of Germany ..... 3244532

[51] Int. Cl.[4] ..... A24C 5/18; A24C 5/39

[52] U.S. Cl. ..... 131/84.3; 131/108; 131/110; 131/109.2

[58] Field of Search ..... 131/84 B, 108, 109 R, 131/109 B, 109 AB, 66 R, 909

[56] References Cited

U.S. PATENT DOCUMENTS

| | | | |
|---|---|---|---|
| 4,175,570 | 11/1979 | Heitmann | 131/84 B |
| 4,185,644 | 1/1980 | Heitmann et al. | 131/109 R |
| 4,235,248 | 11/1980 | Schumacher | 131/108 |
| 4,373,538 | 2/1983 | Steiniger | 131/109 R |
| 4,463,768 | 8/1984 | Quarella | 131/84 B |
| 4,484,589 | 11/1984 | Steiniger et al. | 131/110 |

*Primary Examiner*—V. Millin
*Assistant Examiner*—H. Macey
*Attorney, Agent, or Firm*—Peter K. Kontler

[57] ABSTRACT

A homogeneous tobacco stream is built upon an air-permeable conveyor in a channel which is adjacent to one side of the conveyor and is bounded by two sidewalls. Particles of tobacco are admitted against the concave side of an arcuate guide wall, whose discharge end is adjacent to the channel and remote from the one side of the conveyor, together with streams of compressed air which accelerate the particles of tobacco and transport them toward and beyond the discharge end of the guide wall. The concave side of the guide wall has three guide faces each of which directs a discrete partial stream of tobacco particles against a different portion of the one side of the conveyor whereon the particles are retained by suction. The guide faces are staggered with reference to each other, as considered transversely of the direction of transport of tobacco particles at the one side of the conveyor, and terminate at edge faces beyond which the respective partial streams are propelled by inertia as well as under the action of the air streams. The partial streams of tobacco are directed against the two marginal portions of the one side of the conveyor adjacent to the respective sidewalls and against the central portion of the one side. Such partial streams impinge upon conveyor portions which are staggered with reference to each other, as considered in the direction or movement of the conveyor.

23 Claims, 13 Drawing Figures

Fig.2
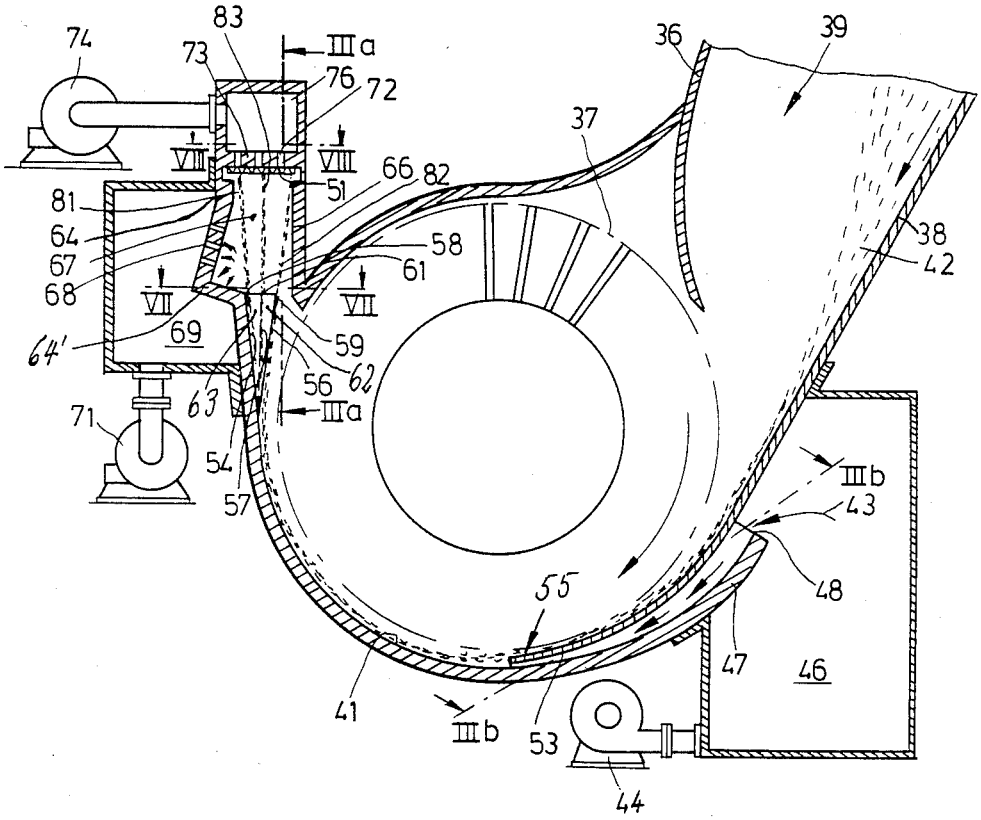
Fig.3a
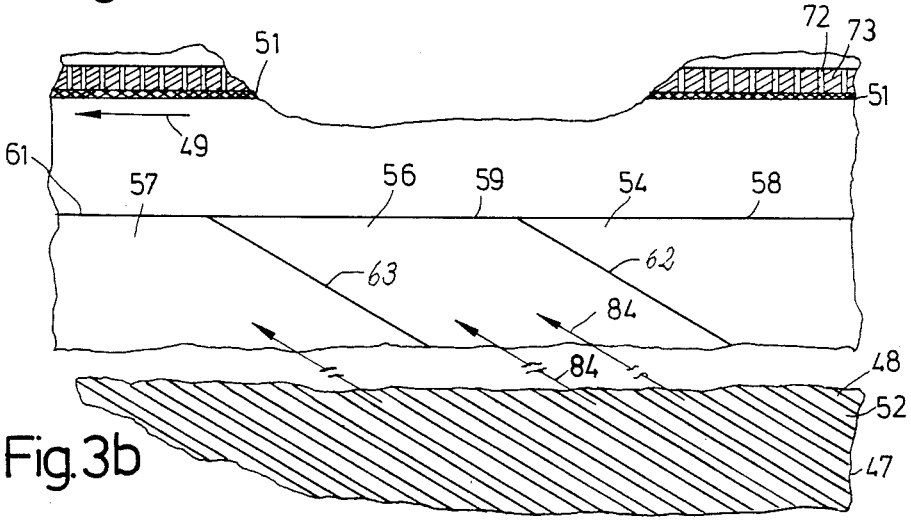
Fig.3b

Fig.4
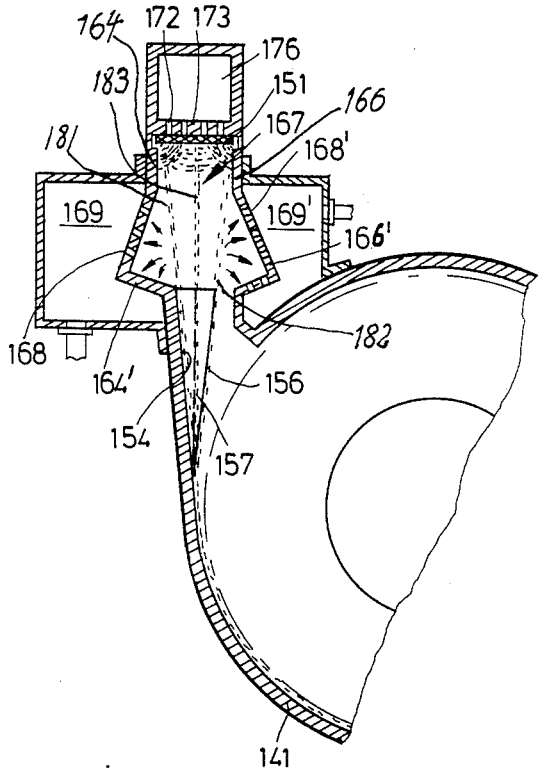
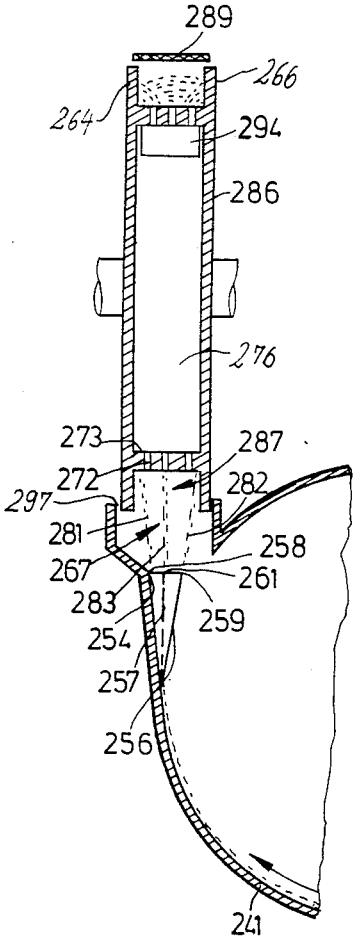
Fig.6

METHOD OF AND APPARATUS FOR BUILDING A TOBACCO STREAM

CROSS-REFERENCE TO RELATED CASES

The apparatus which is disclosed in the present application is identical with those disclosed in the commonly owned copending application Ser. No. 557,641 filed Dec. 2, 1983 by Uwe Heitmann and in the commonly owned copending application Ser. No. 557,732 filed Dec. 2, 1983 by Uwe Heitmann. Furthermore, the apparatus of the present invention is in part similar to the apparatus disclosed in the commonly owned copending application Ser. No. 557,733 filed Dec. 2, 1983 by Günter Wahle et al. and in the commonly owned copending application Ser. No. 392,775 filed June 28, 1982 by Guido Quarella.

BACKGROUND OF THE INVENTION

The present invention relates to a method of building a tobacco stream on an air-permeable conveyor and to an apparatus which can be used in the distributor of a cigarette rod making machine for the making of a tobacco stream which is to be converted into, or which can constitute, a tobacco filler, i.e., the tobacco-containing constituent of a cigarette rod.

It is known to build a tobacco stream at one side of an air-permeable conveyor the other side of which is adjacent to a suction chamber in order to attract the particles of tobacco to the conveyor while such particles are in the process of forming a growing tobacco stream as well as to attract the fully grown stream during transport toward the trimming station or directly to the wrapping station of the rod making machine. Tobacco particles are propelled by streams of compressed air to travel across an elongated channel which is defined by the conveyor and two spaced-apart sidewalls and is adjacent to the one side of the conveyor. In many instances, the tobacco channel has a rectangular cross-sectional outline and the means for supplying tobacco can constitute an arcuate guide wall the concave side of which serves as a support for the tobacco stream which is caused to advance toward and into the channel. The directions of air streams which advance the particles of tobacco along the guide wall are such that the particles which leave the guide wall travel across the channel and impinge upon the one side of the conveyor. Reference may be had to commonly owned U.S. Pat. No. 4,175,570 granted Nov. 27, 1979 to Uwe Heitmann. A drawback of presently known apparatus which build a continuous tobacco stream in the aforeoutlined manner is that the conditions in the channel are unpredictable. Thus, the air streams are likely to form eddy currents and/or other stray currents which prevent predictable propagation of tobacco particles from the guide wall toward the conveyor in such a way that the latter can accumulate a homogeneous tobacco stream. It has been found that the density of the thus formed tobacco stream is not always uniform. For example, the density of a freshly formed tobacco stream is less pronounced along the marginal portions of the conveyor (adjacent to the two sidewalls) than along the central portion. This affects the quality of the filler which is obtained when the surplus of tobacco particles is removed from the fully grown stream. The inability of conventional apparatus to form a homogeneous tobacco stream with a requisite degree of predictability and for extended periods of time is also attributable to the fact that the channel must receive relatively large quantities of air in order to ensure the admission of requisite quantities of tobacco particles and that the evacuation of surplus air (namely, of that percentage of air which cannot be evacuated through the air-permeable conveyor) presents many problems.

OBJECTS AND SUMMARY OF THE INVENTION

An object of the invention is to provide a novel and improved method of building a continuous tobacco stream whose density is more uniform across the entire cross-section than in the streams which are obtained in accordance with heretofore known proposals.

Another object of the invention is to provide a method which ensures the formation of a homogeneous tobacco stream in a channel having a polygonal cross-sectional outline so that the particles of tobacco must penetrate into corners that are hard to fill or cannot be properly filled at all by resorting to conventional techniques.

A further object of the invention is to provide a method which ensures the making of a homogeneous tobacco stream whose density is uniform in each and every part of its cross-section regardless of the quantity of air which is used to transport tobacco particles into the stream building zone.

An additional object of the invention is to provide a method which can be practiced to build a continuous tobacco stream at a rate which is required in modern high-speed cigarette makers serving to turn out up to and in excess of 8000 cigarettes per minute.

Still another object of the invention is to provide a novel and improved apparatus for the practice of the above outlined method and to construct and assemble the apparatus in such a way that each and every portion of the channel at one side of the air-permeable conveyor can receive identical or substantially identical quantities of tobacco particles.

A further object of the invention is to provide an apparatus wherein the development of eddy currents or vagrant streams of air in the channel is prevented or reduced to a minimum in a simple and reliable way.

Another object of the invention is to provide the apparatus with novel and improved means for supplying tobacco particles into the stream building zone.

An additional object of the invention is to provide the apparatus with novel and improved means for preventing the surplus of air in the channel from adversely influencing the formation of a homogeneous tobacco stream.

A further object of the invention is to provide a novel and improved tobacco transporting conveyor for use in the above outlined apparatus.

An additional object of the invention is to provide an apparatus which is at least as compact as heretofore known apparatus but is capable of building a continuous tobacco stream whose homogeneousness is much more satisfactory than that of tobacco streams which are formed in conventional apparatus.

A further object of the invention is to provide the apparatus with novel and improved means for controlling the flow of air streams and the propagation of tobacco particles in the stream building zone.

One feature of the invention resides in the provision of a method of building a tobacco stream on an air-permeable conveyor which is driven to advance the stream in a predetermined direction and cooperates with a first and a second sidewall to define a channel extending in the predetermined direction at one side of the conveyor. The method comprises the steps of establishing a pressure differential between the one side and the another side of the conveyor to thus induce the flow of air from the channel through the conveyor, establishing a source of tobacco particles, for example, at a location which is remote from the channel, conveying streams of air into the channel and toward selected portions of the one side of the conveyor which are staggered with reference to one another, as considered transversely of and in the predetermined direction, and admitting tobacco particles from the source into the air streams so that the thus admitted particles of tobacco share the movements of the air streams and are deposited on and adhere to the selected portions of the one side of the conveyor. The method preferably further comprises the step of establishing a source of compressed air; the conveying step then comprises conveying streams of compressed air from the respective source along the concave side of an arcuate path and into the channel, and the admitting step then comprises admitting particles of tobacco into the arcuate path. The method preferably further comprises the step of establishing for the partial tobacco streams discrete trajectories for the propulsion of the respective tobacco particles by streams of compressed air across the channel and toward the selected portions of the one side of the conveyor. The one side of the conveyor has spaced-apart first and second marginal portions which are adjacent to the corresponding sidewalls and a central portion between the two marginal portions, and the step of establishing discrete trajectories can comprise establishing first and second trajectories for the propagation of discrete first and second partial tobacco streams toward the respective marginal portions and a third trajectory for the propagation of a third partial tobacco stream toward the central portion of the one side of the conveyor. The trajectories can extend at least substantially tangentially of the arcuate path.

At least in many instances, the step of conveying air streams from the respective source includes admitting into the channel compressed air at a rate exceeding the rate of evacuation of air through the conveyor as a result of the establishment of a pressure differential between the two sides of the conveyor. Therefore, at least one of the two sidewalls is preferably provided with a recessed air-permeable portion which is adjacent to the locations of establishment of discrete trajectories (i.e., adjacent to the discharge end of the arcuate path), and the method then further comprises the step of withdrawing the excess or surplus of compressed air from the channel by way of the air-permeable portion of the one sidewall.

It is preferred to impart to the air streams in the arcuate path and to the partial tobacco streams a component of movement in the direction of transport of the stream which is built up at the one side of the conveyor; this reduces the likelihood that the particles of tobacco would rebound and/or otherwise shift their positions subsequent to impingement upon the conveyor.

It is further advisable to increase the rate of air flow through those portions of the conveyor which are in the process of receiving partial streams of tobacco particles. In other words, the particles can be attracted to the conveyor with a greater force while they are in the process of coming to rest on the conveyor or on the previously deposited particles, and the particles which already adhere to the conveyor can be held thereon with a reduced force.

The method can further comprise the steps of classifying tobacco particles and admitting selected fractions of classified particles into the respective source.

As a rule, or at least in many instances, the step of establishing discrete trajectories will involve propelling the partial tobacco streams upwardly and in directions at an acute angle to the vertical.

Another feature of the invention resides in the provision of an apparatus for building a continuous tobacco stream, for example, a stream which can be converted into or which constitutes the filler of a cigarette rod. The apparatus comprises a conveyor including a driven air-permeable element having first and second sides disposed opposite each other and serving to advance the tobacco stream in a predetermined direction, suction generating means adjacent to the first side of the air-permeable element, spaced-apart first and second sidewalls adjacent to the second side of and defining with the air-permeable element an elongated channel which extends in the predetermined direction, a source of tobacco particles, and guide means for conveying tobacco particles from the source into the channel. The guide means includes a plurality of guide faces which are staggered with reference to each other, as considered transversely of and in the predetermined direction, and the guide means is further formed with edge faces which are remote from the air-permeable element. Each guide face terminates at a different one of the edge faces and each guide face serves to direct tobacco particles toward a selected portion of the second side of the air-permeable element. The guide means preferably defines an arcuate path which is disposed upstream of the guide faces (as considered in the direction of travel of tobacco particles toward the channel) and the source is arranged to admit tobacco particles into the arcuate path. Such apparatus further comprises a source of compressed air and a nozzle or other suitable means for admitting streams of compressed air from the respective source into the arcuate path so that the air streams entrain the particles of tobacco toward, along and beyond the guide faces for deposition on the selected portions of the second side of the air-permeable element. The guide faces are arranged to direct partial streams of tobacco particles beyond the respective edge faces and toward the selected portions of the second side of the air-permeable element so that each partial stream has its own trajectory extending across the channel and terminating at the second side of the air-permeable element. The edge faces are or can be disposed in the channel. Furthermore, imaginary lines which extend beyond the edge faces and tangentially of the respective guide faces intersect the corresponding selected portions of the one side of the air-permeable element, i.e., the trajectories of the partial tobacco streams can be straight to allow for the propagation of tobacco particles along the shortest possible routes from the respective edge faces toward the second side of the air-permeable element of the conveyor.

The air-permeable element has first and second marginal portions which are adjacent to the respective (first and second) sidewalls, and a central portion between the two marginal portions. The orientation of the guide faces is preferably such that two (first and second) guide faces respectively direct first and second partial streams of tobacco particles toward the first and second marginal portions of the air-permeable element and a third guide face directs a third partial stream of tobacco particles toward the central portion of the air-permeable element.

The tobacco supplying means preferably further includes transversely extending surfaces which alternate with the guide faces and are inclined with reference to the predetermined direction.

The suction generating means can include a wall which is adjacent to the first side of the air-permeable element and has groups of openings in register with selected portions of the second side of the air-permeable element. Such suction generating means can comprise a suction chamber and the just mentioned wall can constitute the bottom wall of the suction chamber.

At least one of the sidewalls can be provided with a recessed air-permeable portion which is adjacent to the edge faces of the tobacco supplying means, and such apparatus can further comprise means (e.g. including a suction chamber which is outwardly adjacent to the recessed portion of the one sidewall) for drawing air from the channel by way of the air-permeable portion.

The conveyor can include an endless band or belt conveyor having an elongated stretch which constitutes the air-permeable element. Alternatively, the conveyor can comprise a hollow rotary disc having a circumferentially extending wall which constitutes the air-permeable element.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged vertical sectional view of a detail in the distributor of FIG. 1, showing the means for feeding tobacco particles into the channel adjacent to the air-permeable element of the tobacco stream forming and transporting conveyor;

FIG. 3*a* is an enlarged fragmentary transverse vertical sectional view as seen in the direction of arrows from the line IIIa—IIIa of FIG. 2;

FIG. 3*b* is an enlarged fragmentary elevational view as seen in the direction of arrows from the line IIIb—IIIb of FIG. 2;

FIG. 4 is a fragmentary vertical sectional view similar to that of FIG. 2 but showing a portion of a modified distributor;

FIG. 6 is a fragmentary transverse vertical sectional view as seen in the direction of arrows from the line VI—VI of FIG. 5*a;*

DESCRIPTION OF THE PREFERRED EMBODIMENTS

Figure 1:
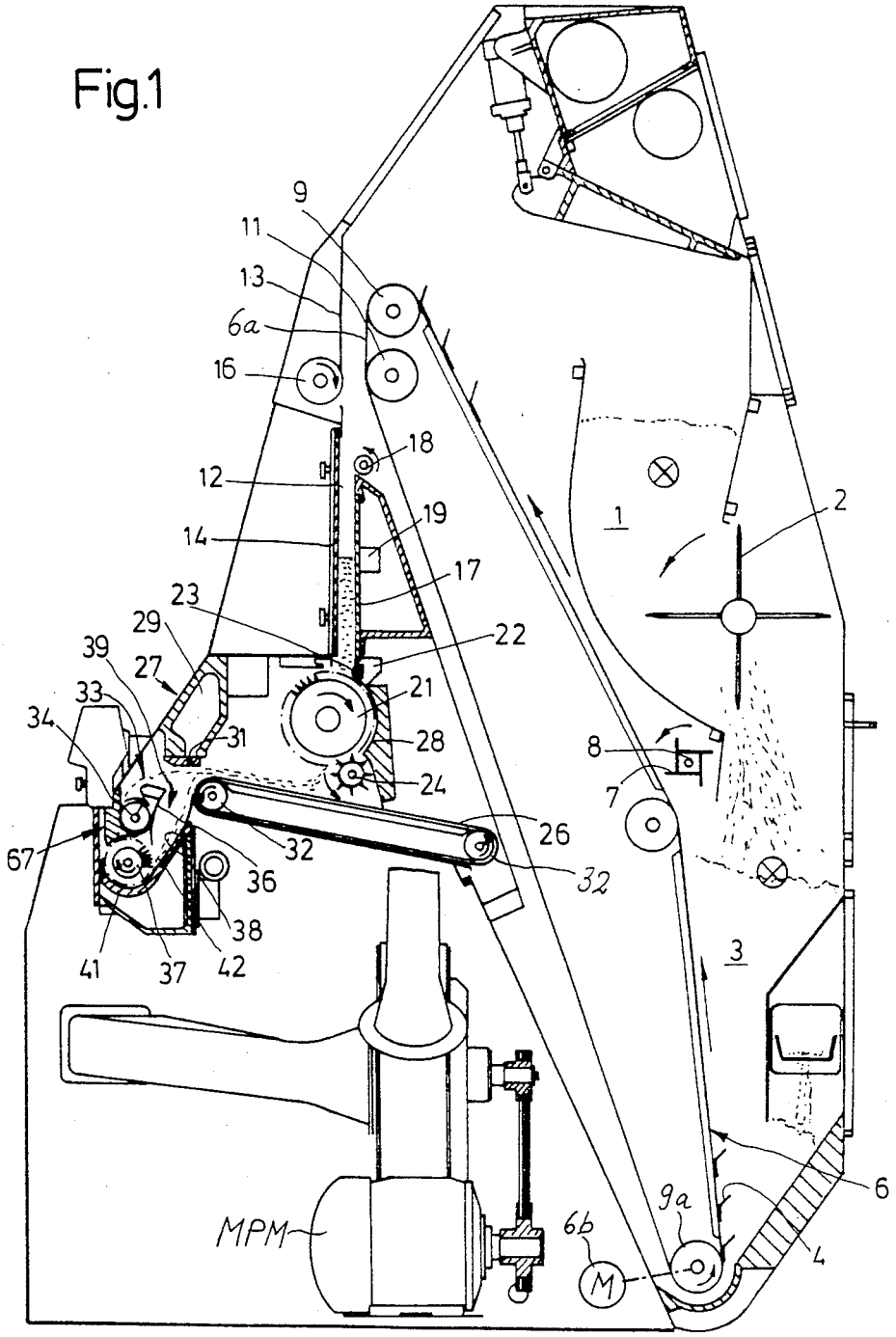
FIG. 1 is a side elevational view of a distributor which forms part of a cigarette rod making machine and embodies one form of the invention, the front sidewall of the frame of the cigarette rod making machine being omitted and certain parts being shown in a vertical sectional view.

FIG. 1 shows a distributor which comprises a main magazine 1 containing a rather substantial supply of tobacco particles (normally including mainly tobacco shreds, some short tobacco, some fragments of tobacco ribs and possibly a few pieces of metal). A rotary rake 2 is provided to transfer tobacco from the main magazine 1 into a smaller second magazine 3 which has an open side adjacent to the upwardly moving reach of a steep endless belt conveyor 6. The conveyor 6 has equidistant external entraining elements 4 which define pockets serving to draw batches of tobacco particles from the supply in the second magazine 3, and each such batch is equalized by a driven paddle wheel 8 having flexible vanes or paddles 7 (e.g., in the form of leather straps) which brush off the surplus from successive batches while the entraining elements 4 advance toward a pulley 9 at the upper end of the conveyor 6. The pulley 9 is rather closely adjacent to and is disposed at a level above a deflecting roller 11 which ensures that the uppermost portion 6*a* of the left-hand reach of the conveyor 6 is vertical or nearly vertical, namely, that the portion 6*a* is at least substantially parallel to an upright guide wall 13 constituting an upward extension of the left-hand or front sidewall 14 of an upright duct 12. The guide wall 13 has an opening for a portion of a driven magnetic roller 16 serving to attract particles of metallic material, if any, which might be present in the batches of tobacco that are dumped by successive entraining elements 4 subsequent to travel around the pulley 9. The top portion of the right-hand or rear sidewall 17 of the duct 12 carries a driven roller 18 which is rotated at a constant speed and prevents shreds or other particles of tobacco from accumulating on top of the sidewall 17. The portion 6*a* of the left-hand reach of the conveyor 6 cooperates with the guide wall 13 and with the driven roller 18 to ensure that all particles of tobacco which are dumped by successive entraining elements 4 find their way into the duct 12.

The rear sidewall 17 of the duct 12 carries a monitoring device 19 which preferably includes a battery of reflection type photocells (not specifically shown). The photocells are staggered, as considered in as well as at right angles to the plane of FIG. 1, and generate signals denoting the levels of the corresponding portions of the column of tobacco particles in the duct 12. The photocells are electrically connected to each other and transmit signals when they are disposed at levels below the adjacent portions of the tobacco column in the duct 12 for preselected intervals of time. The signals are transmitted via suitable time-delay elements and serve to control the operation of a variable-speed motor 6b for the lower pulley 9a of the conveyor 6. This ensures that the level of the top surface of the column of tobacco particles in the duct 12 is constant or fluctuates only slightly within a rather narrow range. Reference may be had, for example, to commonly owned U.S. Pat. No. 4,223,845 granted Sept. 23, 1980 to Fritz Selonke et al. and particularly to commonly owned U.S. Pat. No. 4,235,248 granted Nov. 25, 1980 to Peter Schumacher.

The discharge end of the duct 12 is located at the one o'clock position of a rotary carded conveyor in the form of a drum 21 which is driven at a variable speed by the main prime mover MPM of the rod making machine through the medium of a suitable transmission, not shown. The carding of the drum 21 is filled with tobacco particles during travel below the open lower end of the duct 21, and the uniformity of such filling is enchanced by a reciprocable homogenizing element 22 which is installed below the lower end portion of the sidewall 17 and has a profiled projection 23 extending into the pile of tobacco particles in the lower portion of the duct 12. The manner in which the homogenizing element 22 can enhance the penetration of tobacco particles into and uniform distribution of such particles in the carding of the drum 21 is fully disclosed in commonly owned U.S. Pat. Nos. 3,996,943 and 3,996,944 granted Dec. 14, 1976 to Alfred Hinzmann. The homogenizing element 22 is a bar or strip which is caused to oscillate in directions substantially at right angles to the plane of FIG. 1 and at a frequency which varies with the speed of the carded drum 21.

A rapidly driven rotary picker roller 24 is adjacent to the carding at the five o'clock position of the drum 21 and serves to expel the particles of tobacco from the carding so that the expelled particles accumulate on the upper reach of an upwardly sloping endless apron conveyor 26 and form thereon a layer or carpet which is transported toward, and successive increments of which are propelled into, a classifying device 27. The directions in which the carded drum 21 and the picker roller 24 rotate are indicated by arrows. The picker roller 24 is driven at a constant speed and is partially surrounded by a stationary shroud 28 which further partially surrounds the drum 21 and extends from the homogenizing element 22 all the way to the upper reach of the apron conveyor 26. The purpose of the shroud 28 is to prevent escape of tobacco particles from the carding of the drum 21 on their way from the outlet of the duct 12 toward the picker roller 24 as well as to prevent propulsion of tobacco particles (by the needles or pins of the picker roller 24) in a direction to the right, as viewed in FIG. 1, and beyond the rear end portion of the upper reach of the apron conveyor 26. The front pulley 32 for the apron conveyor 26 is driven at a constant speed by a suitable motor, not shown, e.g., by the motor which also drives the picker roller 24. The external surface of the apron conveyor 26 is preferably profiled and preferably constitutes the exposed side of a layer consisting of rubber or another elastomeric material which is capable of enhancing friction so as to ensure that tobacco particles which form the aforementioned carpet advance toward the left-hand pulley 32 at least substantially without slippage.

The classifying device 27 comprises a plenum chamber 29 having a bottom portion provided with a horizontal row of square or rectangular openings 31 serving to direct jets of compressed air downwardly in front of the apron conveyor 26. Such jets form a curtain which can deflect lightweight particles of tobacco but does not appreciably influence (alter) the trajectories of heavier particles which thus traverse the curtain and accumulate in a collecting receptacle 33. The bottom portion of the receptacle 33 surrounds a rotary feed screw 34 which serves to evacuate the heavier particles (particularly fragments of tobacco ribs) from the classifying device 27, either continuously or at regular or irregular intervals. The openings 31 are closely adjacent to each other so that the curtain of air is practically uninterrupted and thus reduces the likelihood of propulsion of satisfactory tobacco particles into the receptacle 33. The classifying device 27 further comprises a vertically adjustable barrier 36 which can be moved to any one of a number of different levels to select the quantity and weight of particles which are permitted to enter the receptacle 33. Thus, if the barrier 36 is moved to a higher level, the particles which are partially deflected by the air curtain are prevented from entering the receptacle 33 because they impinge upon the concave right-hand side of the barrier. Inversely, when the barrier 36 is moved to a lower level, it allows the heaviest as well as less heavy particles to enter the receptacle 33. The concave right-hand side of the barrier 36 directs the intercepted particles of tobacco (especially shreds) downwardly and into a duct 39 which gathers a tobacco stream 42 (see also FIG. 2) that slides along the inner side of a downwardly sloping wall 38. The latter causes successive increments of the stream 42 to enter the range of radially outwardly extending pins or needles at the periphery of a rotary carded conveyor 37 which is driven in a clockwise direction, as viewed in FIG. 1 or 2, and at a constant speed by a suitable prime mover, e.g., the aforementioned prime mover which drives the picker roller 24 and the apron conveyor 26. The duct 39 is defined by the barrier 36, by the wall 38 and by the carded conveyor 37, and the purpose of this duct is to receive and control the direction of advancement of all tobacco particles which are incapable of penetrating the air curtain and entering the receptacle 33 of the classifying device 27.

The lower portion of the wall 38 overlies a portion of an arcuate guide wall 41 whose concave upper side faces the adjacent lower portion of the carded conveyor 37 and which constitutes a means for supplying tobacco particles into an elongated tobacco channel 67. The concave side of the guide wall 41 is spaced apart from the tips of adjacent pins of the carded conveyor 37 to provide room for advancement of tobacco particles toward and into the lower portion of the channel 67 as well as for influencing of such particles during travel from the inlet toward the outlet of the arcuate path which is defined by the guide wall 41. The curvature of the concave side of the guide wall 41 preferably equals or approximates the curvature of the periphery of the carded conveyor 37.

The inlet of the arcuate path which is defined by the guide wall 41 (namely, the region where successive increments of a stream 42 of tobacco particles leave the wall 38 and duct 39 and descend onto the wall 41) is adjacent to an air admitting device which serves to admit several streams of compressed air (note the arrow 43) into the funnel-shaped gap between the rearmost portion 47 of the guide wall 41 and the lowermost portion 53 of the wall 38. Compressed air issues from a plenum chamber 46 which is connected to the pressure side of a blower 44. The reference character 48 denotes in FIG. 2 one of several partitions which are provided at the concave inner side of the guide wall 41 and serve to impart to the respective air streams a component of movement in the direction (arrow 49 in FIG. 3*a*) of advancement of the lower reach (air-permeable element) of an endless band-like tobacco stream transporting conveyor 51. The lower reach of the conveyor 51 constitutes the upper boundary of the aforementioned tobacco channel 67 which is flanked by two spaced-apart parallel upright sidewalls 64 and 66 of the distributor. The channel 67 is disposed at a level below the lower reach of the conveyor 51, and the upper side of such lower reach is adjacent to a stationary suction chamber 76 having a bottom wall 73 with openings 72 which permit air to flow from the channel 67 into the suction chamber 76.

The partitions or vanes 48 at the concave side of the guide wall 41 are elongated ribs (see FIG. 3*b*) which define between themselves a plurality of relatively narrow passages 52 for the flow of streams of compressed air from the plenum chamber 46 into the arcuate path at the concave side of the guide wall 41 below the carded conveyor 37. The direction of flow of such streams of compressed air is indicated by arrows 84, and it will be noted that each air stream has a component of movement in the direction (arrow 49) in which the underside of the lower reach of the conveyor 51 advances the growing and the fully grown tobacco stream within and from the channel 67.

The lowermost portion 53 of the downwardly sloping wall 38 of the duct 39 constitutes a cover which is spaced apart from and overlies the passages 52 between the partitions 48 of the guide wall 41, and the concave upper side of the cover 53 guides successive increments of the tobacco stream 42 into the body of compressed air which together forms the streams flowing in and beyond the passages 52. The parts 47, 48 and 53 can be said to constitute an air admitting nozzle 55 whose interior is subdivided into the aforementioned passages 52 by the partitions 48 and which directs the streams of compressed air in the directions indicated by the arrows 84 to thereby control the acceleration as well as the direction of movement of tobacco particles which form the stream 42 and enter the space between the lower portion of the carded conveyor 37 and the non-overlapped portion of the arcuate guide wall 41.

The outlet of the path which is defined by the concave upper side of the guide wall 41 terminates at three edge faces 58, 59, 61 of the guide wall 41. Such edge faces are spaced apart from the underside of the lower reach of the conveyor 51 and are staggered with reference to each other, as considered transversely of the direction which is indicated by the arrow 49. The edge faces 58, 59, 61 are respectively disposed at the discharge ends of three guide faces 54, 56, 57 which are defined by the outlet portion of the guide wall 41 at a level below the channel 67 and along which three discrete partial streams 81, 82, 83 of tobacco particles advance in the directions indicated by the arrows 84, i.e., each with a component of movement in the direction of arrow 49. Tobacco particles and streams of compressed air which flow along the guide faces 54, 56, 57 are caused to advance beyond the respective edge faces 58, 59, 61 and toward the underside of the lower reach of the conveyor 51. The orientation of the guide faces 54, 56, 57 with reference to the underside of the lower reach of the conveyor 51 is such that imaginary lines extending therealong and being tangential to the guide wall 41 point toward different portions of the underside of the aforementioned lower reach. Thus, the guide face 54 of the guide wall 41 directs the partial stream 81 of tobacco particles against the left-hand marginal portion of the lower reach of the conveyor 51, as viewed in FIG. 2 (close to the sidwall 64), the guide face 57 directs the partial stream 82 of tobacco particles against the right-hand marginal portion of the underside of the lower reach (close to the sidewall 66), and the guide face 56 directs the partial stream 83 of tobacco particles against the median or central portion of the underside of the lower reach of the conveyor 51. In the embodiment of FIG. 2, the guide faces 54, 56, 57 are flat or substantially flat and their edge faces 58, 59, 61 are equidistant from the underside of the lower reach of the conveyor 51.

The guide faces 54, 56 are separated from each other by an additional surface 62 of the guide wall 41, and the guide faces 56, 57 are separated from one another by an additional surface 63. The inclination of additional surfaces 62 and 63 is the same as that of the air streams which carry the particles of tobacco into the channel 67, i.e., beyond the edge faces 58, 59 and 61. Such inclination of the additional surfaces 62, 63 ensures that the partial tobacco streams 81, 82 and 83, which are propelled beyond the respective edge faces 58, 61, 59 of the guide wall 41, cannot interfere with each other during travel in the channel 67 and toward the lower reach of the conveyor 51.

The sidewall 64, which bounds the left-hand side of the channel 67 in FIG. 2, has an air-permeable portion or section 64' which slopes downwardly and outwardly in a direction away from the other sidewall 66 and has openings 68 which establish communication between the channel 67 and a suction chamber 69 which is outwardly adjacent to the portion 64' of the sidewall 64 and is connected to the suction intake of a blower 71. The portion 64' merges into the lowermost portion of the sidewall 64 at the general level of the edge faces 58, 59, 61 and the lower portion of the sidewall 64 merges gradually into the guide wall 41. The lower part of the air-permeable portion 64' defines a pronounced ledge at the level of the edge faces 58, 59, 61 and the openings 68 are spaced apart from the nearest partial stream 81 of tobacco particles. Such configuration of the air-permeable portion 64' ensures that the suction chamber 69 can draw some (surplus) air from the channel 67 but that the streams of air passing through the openings 68 are not likely to entrain particles of tobacco whose inertia should be sufficient to ensure that they remain in the streams 81, 82, 83 and to continue their movement in the channel 67 toward the underside of the lower reach of the conveyor 51. This ensures that the openings 68 are not likely to be clogged with particles of tobacco, i.e., that the suction chamber 69 is free to draw from the channel 67 all such air which is not or cannot be caused to pass through the interstices of the lower reach of the conveyor 51, through the openings 72 in the bottom wall 73 and into the suction chamber 76. The latter is connected to the suction intake of a blower 74.

Figure 8:
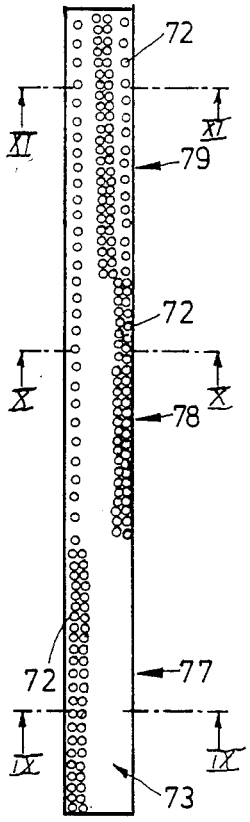
FIG. 8 is a plan view of the bottom wall of a suction chamber in the distributor of FIG. 1, substantially as seen in the direction of arrows from the line VIII—VIII of FIG. 2.

FIG. 8 shows one presently preferred distribution of openings 72 (e.g., circular holes) in the bottom wall 73 of the suction chamber 76. The section 77 of the bottom wall 73 has two rows of openings 72 which are adjacent to the sidewall 64 and serve to attract the particles of the partial stream 81. The next section 78 of the bottom wall 73 (as considered in the direction (arrow 49) of advancement of tobacco particles with the conveyor 51) has two rows of openings 72 adjacent to the sidewall 66 to attract the particles of the partial stream 82 and a single row of openings 72 adjacent to the sidewall 64 to hold the particles of the partial stream 82. The third section 79 of the bottom wall 73 has two centrally located rows of openings 72 to attract the particles of the partial tobacco stream 83 and two additional rows of openings 72 which are adjacent to the sidewalls 64 and 66 and serve to hold the corresponding particles of tobacco (previously the particles of the partial streams 81, 82) at the underside of the lower reach of the conveyor 51. Thus, the partial streams 81, 82, 83 are attracted with greater force to the respective portions or sections of the lower reach of the conveyor 51 while their particles are still in the process of travelling upwardly through the channel 67, and the particles which have come to rest at the underside of the lower reach of the conveyor 51 are attracted with lesser force which should suffice to ensure that the particles share the movement of the conveyor 51 in the direction which is indicated by the arrow 49.

The mode of operation of the distributor which embodies the structure of FIGS. 1, 2, 3*a*, 3*b* and 7 to 11 is as follows:

The entraining elements 4 of the conveyor 6 draw relatively small batches of tobacco particles from the second magazine 3 and the quantity of tobacco in each batch matches or approximates the quantity of tobacco in the preceding batch after a batch advances beyond the paddle wheel 8 whose flexible paddles or vanes 7 remove the surplus and return the removed material into the magazine 3. Successive equalized batches are dumped during travel around the pulley 9 and descend between the portion 6*a* of the left-hand reach of the conveyor 6 and the guide wall 13 to enter the duct 12 wherein they form a column of tobacco particles. Any particles of metal which might be present in the dumped equalized batches are extracted by the rotating magnetic roller 16. The device 19 monitors the height of the column of tobacco in the duct 12, and its signals regulate the operation of the motor 6*b* for the lower pulley 9*a* of the conveyor 6 so that the speed of the conveyor 6 increases when the level of the top surface of the tobacco column in the duct 12 descends below an acceptable minimum level but the speed of the conveyor 6 is increased when the level of the top surface of the column of tobacco rises above the maximum acceptable level. The arrangement is or can be such that the motor 6*b* varies the speed of the conveyor 6 in stepwise fashion.

The rotating carded drum 21 draws particles of tobacco from the lower end of the duct 12 and its carding is uniformly filled with tobacco particles by the continuously oscillating homogenizing element 22. At the same time, the upwardly extending profiled projection 23 of the homogenizing element 22 loosens the material in the lower portion of the column of tobacco in the duct 12 to ensure predictable advancement of loosened particles into the range of the carding on the drum 21.

The upper part of the shroud 28 prevents escape of tobacco particles from the carding of the drum 21 on their way from the discharge end of the duct 12 toward the picker roller 24, and the lower part of this shroud prevents the picker roller 24 from propelling particles of tobacco rearwardly and beyond the right-hand pulley 32 for the apron conveyor 26, as viewed in FIG. 1. If desired, that portion of the shroud 28 which is adjacent to the picker roller 24 can constitute or resemble a comb whose prongs alternate with the pins of the picker roller, as considered at right angles to the plane of FIG. 1. The particles of tobacco which are expelled from the carding of the drum 21 by the pins of the picker roller 24 descend onto and form on the continuously running apron conveyor 26 a relatively wide carpet whose increments advance toward and beyond the left-hand pulley 32. As a rule, longer shreds of tobacco are held by the pins of the picker roller 24 somewhat longer than the shorter shreds; this is desirable and advantageous for the classifying action of the device 27. Thus, the longer shreds are deposited on the upper reach of the apron conveyor 26 nearer to the right-hand pulley 32 than the shorter shreds and other particles so that such shorter shreds and other particles come to rest on the longer shreds and the longer shreds do not interfere with propulsion of shorter shreds and other particles beyond the left-hand end turn of the conveyor 26.

The apron conveyor 26 transports the carpet of tobacco particles thereon at a constant speed, and successive increments of such carpet are propelled toward the curtain of air issuing from the openings 31 in the bottom portion of the plenum chamber 29. The inertia of heavier particles (such as fragments of ribs which would be likely to puncture the wrapping material for a tobacco filler) suffices to ensure that the deflection of such particles by the downwardly flowing jets of air, which form the aforementioned curtain below the openings 31, is zero or insufficient to prevent the heavier particles from entering the collecting receptacle 33 and descending into the range of the feed screw 34. The feature that the longer shreds are located in the lower portion of the tobacco carpet on the upper reach of the apron conveyor 26 ensures that the longer shreds cannot interfere with the propulsion of heavier tobacco particles (on top of the shreds) across the curtain of air, and the trajectories of the heavier particles are such that all heavier particles enter the receptacle 33. All other particles of the carpet are deflected by the curtain of air to a greater or lesser extent but sufficiently to descend directly into the duct 39 or to impinge upon the concave right-hand side of the vertically adjustable barrier 36 which causes the impinging particles to slide therealong and to descend into the duct 39, i.e., onto the downwardly sloping upper side of the wall 38 in the region where the plenum chamber 46 admits compressed air into the passages 52 of the nozzle 55. The leader of the tobacco stream 42 on the wall 38 enters the arcuate path at the concave upper side of the guide wall 41 downstream of the cover 53.

The mass of compressed air which flows from the plenum chamber 46 in the direction of arrow 43 enters the passages 52 between the partitions 48 in the interior of the nozzle 55, and such mass of air forms a substantial number of discrete streams which flow in directions indicated by the arrows 84 to meet the particles of tobacco at the downstream end of the cover 53. Each air stream in the nozzle 55 has a component of movement in the direction (arrow 49) of movement of the lower reach of the conveyor 51 above the channel 67. It will be noted that the air streams which are formed in the passages 52 of the nozzle 55 engage the particles of tobacco as soon as such particles enter the arcuate path between the non-overlapped portion of the guide wall 41 and the carded conveyor 37. The particles of tobacco are entrained in the directions indicated by the arrows 84 and form a relatively thin layer which closely hugs the concave upper side of the non-overlapped portion of the guide wall 41 during travel toward the outlet of the arcuate path, namely, toward the edge faces 58, 59 and 61 of the guide wall 41. The aforementioned path contains a mixture of tobacco particles (mainly shreds) and streams of compressed air, and the solid particles of such mixture are subdivided into three partial streams 81, 82, 83 by advancing along the guide faces 54, 56 and 57 of the guide wall 41. The guide face 54 directs successive increments of the partial stream 81 toward the left-hand marginal portion of the underside of the lower reach of the conveyor 51 i.e., toward the two rows of openings 72 in the section 77 of the bottom wall 73 of the suction chamber 76, and such increments of the partial stream 81 are propelled beyond the respective edge face 58 to traverse the channel 67 and to impinge upon the underside of the lower reach of the conveyor 51 in register with the several rows of openings 72 in the section 77 of the bottom wall 73 (see the lower part of FIG. 8 and FIG. 9). Thus, tobacco particles of the partial stream 81 form a first portion of a homogeneous tobacco stream at the underside of the lower reach of the conveyor 51, and such first portion of the homogeneous stream is adjacent to the sidewall 64.

Figure 10:
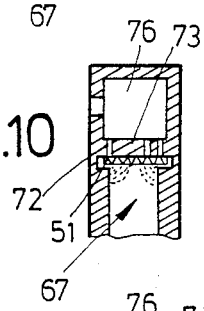
FIG. 10 is a sectional view as seen in the direction of arrows from the line X—X of FIG. 8.
Figure 9:
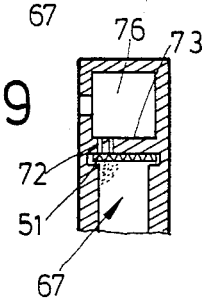
FIG. 9 is a sectional view as seen in the direction of arrows from the line IX—IX of FIG. 8.

The second partial stream 82 travels along the guide face 56 of the guide wall 41 and is propelled beyond the respective edge face 59 to advance toward and to adhere to the right-hand marginal portion of the underside of the lower reach of the conveyor 51 in the region of the two rows of openings 72 in the section 78 of the bottom wall 73 of the suction chamber 76 (see the median portion of FIG. 8 and FIG. 10). The partial stream 82 thus forms a second part of the growing homogeneous tobacco stream at the underside of the lower reach of the conveyor 51, and the first part of the homogeneous tobacco stream (the particles of the partial stream 81) is held against the underside of the lower reach of the conveyor 51 by the single row of openings 72 shown in the left-hand portion of the section 78 of the bottom wall 73.

Figure 11:
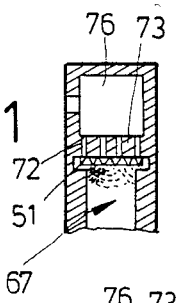
FIG. 11 is a sectional view as seen in the direction of arrows from the line XI—XI of FIG. 8.

The partial stream 83 travels along the guide face 57 and is propelled beyond the edge face 61 to advance toward and to impinge upon the central portion of the underside of the lower reach of the conveyor 51 below the two rows of openings 72 in the section 79 of the bottom wall 73 (see FIGS. 8 and 11). This completes the formation of a homogeneous tobacco stream which overlies the entire underside of the lower reach of the conveyor 51 all the way between the sidewalls 64 and 66. All particles of tobacco which advance beyond the edge faces 58, 59, 61 have a component of movement in the direction of arrow 49 because they advance in the directions which are indicated by the arrows 84. This ensures that the extent of movement of tobacco particles relative to the conveyor 51, upon impingement of such particles on the underside of the lower reach of the conveyor 51, is negligible or nil.

The distribution of openings 72 in a manner as shown in FIGS. 8, 9, 10 and 11 is optional but highly desirable. Thus, the guide faces 54, 56, 57 could suffice to ensure predictable distribution of tobacco particles which form the streams 81, 82 and 83 at the underside of the lower reach of the conveyor 51; however, the distribution of openings 72 in a manner as shown in FIGS. 8 to 11 promotes the formation of a homogeneous tobacco stream which can be converted into a rod-like filler without trimming or with a minimum of trimming. Absence of trimming or a reduction of the extent of trimming entails a reduction of the quantity of short tobacco which develops in the distributor of a cigarette rod making or an analogous machine. The single rows of openings 72 in the sections 78 and 79 of the bottom wall 73 of the suction chamber 76 suffice to ensure adequate retention of the respective portions of the homogeneous tobacco stream on the conveyor 51 during transport of the homogeneous stream toward the trimming station or directly to the wrapping station of the rod making machine. A suitable trimming arrangement for a stream of tobacco particles (except that the stream is disposed at the upper side rather than at the underside of the conveyor) is disclosed in commonly owned U.S. Pat. No. 4,037,608 granted July 26, 1977 to Günter Wahle.

The purpose of the pins on the carded conveyor 37 is to effect further acceleration of tobacco particles which are to form the partial streams 81, 82 and 83. This conveyor constitutes an optional feature of the improved apparatus, i.e., the particles of the stream 42 can be accelerated and caused to change the direction of their travel (to advance in the directions indicated by the arrows 84) exclusively under the action of air streams which are formed in and issue from the nozzle 55.

As a rule, or at least under certain circumstances, the quantity of air which is admitted by the nozzle 55 and flows along the concave upper side of the guide wall 41 toward and into the channel 67 exceeds the quantity of air which can escape through the interstices of the lower reach of the conveyor 51, through the openings 72 of the bottom wall 73 and into the suction chamber 76. The surplus of air which is admitted by the nozzle 55 is withdrawn by the suction chamber 69 via openings 68 in the air-permeable portion 64' of the sidewall 64. As mentioned above, deflection of air which flows in the channel 67 toward the openings 68 is so pronounced that the inertia of ascending tobacco particles in the channel 67 suffices to ensure that such particles remain in the channel 67 and ultimately adhere to the underside of the lower reach of the conveyor 51 rather than to the right-hand side of the air-permeable portion 64', as viewed in FIG. 2. In other words, the trajectories of tobacco particles which form the partial streams 81, 82 and 83 in the channel 67 are not altered by the streams of air which are diverted into the suction chamber 69 by way of the openings 68 in the portion 64'.

An important advantage of the improved method and apparatus is that it is now possible to adequately fill those portions of the channel 67 which cannot be properly filled, or which cannot be filled at all, by resorting to conventional techniques. Thus, even though the channel 67 has a polygonal cross-sectional outline, the apparatus can fill the corners of this channel along the marginal portions of the lower reach of the conveyor 51 with the same degree of predictability and reliability as along the central portion of the lower reach. Thus, the improved apparatus is less likely to build a tobacco stream which exhibits cavities along the sidewalls 64 and 66, and the density of the stream in the central region of the channel need not be higher than along the sidewalls. The orientation of the guide faces 54 and 56 can be readily selected in such a way that the tobacco particles which form the partial streams 81 and 82 are aimed into the corners of the channel 67 adjacent to the sidewalls 64 and 66 so that the development of cavities in such corners is prevented with attendant pronounced improvement in the quality of the tobacco stream.

The feature that the trajectories of tobacco particles which form the partial streams 81, 82 and 83 extend along imaginary lines which are tangential to the arcuate path defined by the guide wall and extend beyond the respective edge faces 58, 59 and 61 ensures that the length of trajectories of all tobacco particles is at least substantially identical. The edge faces 58, 59 and 61 can be disposed in a common horizontal plane which is or can be parallel to the underside of the lower reach of the conveyor 51. The distance between such plane and the conveyor 51 is sufficient to ensure that the duration of free flight of each tobacco particle is substantially the same and that the transition from an arcuate path (at the concave upper side of the guide wall 41) into a straight path takes place sufficiently ahead of the loci of impingement of tobacco particles upon the conveyor 51 so that the particles can be aimed at selected portions of the lower reach of the conveyor where they are most likely to ensure the formation of a homogeneous tobacco stream whose density is at least substantially uniform in each and every portion of its cross section.

The feature that the streams of compressed air have components of movement in the direction (arrow 49) of advancement of the tobacco stream with the conveyor 51 also contributes to the formation of a more satisfactory tobacco stream and to more satisfactory orientation of tobacco particles in the stream because the particles of tobacco which have components of movement in such direction are less likely to skid and/or rebound after they impinge upon the conveyor 51 and/or upon the particles which already adhere to the lower reach of this conveyor. The absence of rebounding and/or other stray movements of tobacco particles relative to the conveyor 51 ensures that the influence of guide faces 54, 56 and 57 upon the particles which form the respective partial streams is not wasted once the particles reach the conveyor.

Predictable formation of a homogeneous tobacco stream is further enhanced by the aforediscussed distribution of openings 72 in the bottom wall 73 of the suction chamber 76, i.e., in such a way that the particles of tobacco are attracted with a greater force during the last stage of their propagation across the channel 67 and with a lesser force when they already form part of the growing or fully grown stream at the underside of the lower reach of the conveyor 51.

The surfaces 62 and 63 of the guide wall 41 (as can be readily seen in FIG. 7, such surfaces alternate with the guide faces 54, 56 and 57 and the respective edge faces 58, 59 and 61) ensure that the orientation of tobacco streams (arrows 84) which accelerate and advance the particles of tobacco during their travel along the concave side of the guide wall 41 remains at least substantially unchanged all the way to the plane of the edge faces 58, 59 and 61. The inclination of the surfaces 62, 63 with reference to the direction (arrow 49) of transport of the tobacco stream at the underside of the lower reach of the conveyor 51 is selected with a view to ensure that the particles of tobacco are not likely to rebound when they complete their travel across the channel 67 and reach the conveyor 51 or the particles of tobacco thereon.

The feature that the locations where the partial streams 81, 82 and 83 impinge upon the lower reach of the conveyor 51 are staggered in the longitudinal direction of the bottom wall 73 also contributes to the formation of a more satisfactory stream because the particles which form these partial streams are much less likely to interfere with each other while they travel across the channel 67. It can be said that the particles which form the streams 81, 82 and 83 impinge upon the conveyor 51, or on the tobacco particles which already adhere to this conveyor, at timely spaced intervals. This enhances the homogeneousness of the stream because the density of the growing stream can be regulated with a higher degree of predictability than if the particles which form the streams 81 and 83 were to impinge upon the lower reach of the conveyor 51 below one and the same section of the bottom wall 73.

An additional important advantage of the improved apparatus is that all (or practically all) particles of tobacco which travel (in unsupported condition) in the channel 67 already have a component of movement in the direction of arrow 49 so that they are much more likely to form at the underside of the lower reach of the conveyor 51 a tobacco stream which is homogeneous all the way from the sidewall 64 to the sidewall 66. This is due to the fact that the particles of tobacco which form the stream 42 are subjected to the action of properly oriented air streams as soon as they advance beyond the cover 53 of the nozzle 55, i.e., as soon as they reach the non-overlapped portion of the concave upper side of the guide wall 41. This gives the air streams ample time to adequately influence all particles of tobacco and to form the three partial streams 81, 82 and 83 which are thereupon aimed upon selected portions of the underside of the lower reach of the conveyor 51 to form a tobacco stream of heretofore unmatched homogeneousness. It will be noted that the distance between the cover 53 (i.e., between the nozzle 55) and the outlet (at 57, 58, 59) of the arcuate path which is defined by the guide wall 41 greatly exceeds the distance between the edge faces 58, 59, 61 and the lower reach of the conveyor 51, i.e., the air streams flowing in the directions indicated by the arrows 84 have ample time to adequately influence all particles of tobacco which are about to advance beyond the respective edge faces of the guide wall 41. The features that the air streams which issue from the nozzle 55 flow along the concave upper side of the guide wall 41 contributes to predictable transport of tobacco particles toward the channel 67 becuase the air streams closely follow the concave side of the wall 41 so that the gaseous media of such streams effect a very pronounced and desirable stabilization of the travel of tobacco particles in the directions which are indicated by arrows 84. The subdivision of the interior of the nozzle 55 into several passages 52 by resort to suitably inclined partitions 48 and cover 53 brings about the advantage that the properly oriented streams of compressed air merge into the tobacco stream 42 substantially tangentially and the particles of tobacco are accelerated (in the directions indicated by arrows 84) practically without any turbulence in the region at the concave upper side of the guide wall 41.

The partitions 48 in the nozzle 55 ensure that each of the partial tobacco streams 81, 82, 83 has a component of movement in the direction (arrow 49) of movement of the lower reach of the conveyor 51. The means for imparting to the partial streams 81, 82 and 83 components of movements in directions toward selected portions of the underside of the lower reach of the conveyor 51 (as described in connection with FIGS. 8 to 11) includes the guide faces 54, 56, 57 as well as the additional surfaces 62 (between 54, 56) and 63 (between 56, 57). The number of guide faces at the outlet of the arcuate path for the transport of tobacco particles toward the channel 67 can be reduced to two or increased to four or more. It has been found that the provision of three guide faces (54, 56, 57) normally suffices to ensure adequate distribution of tobacco particles on all such portions of the underside of the lower reach of the conveyor 51 which are hard to reach without any special undertakings. These portions include the marginal portions which are adjacent to the respective sidewalls 64, 66 and the central portion between such marginal portions. As mentioned above, the additional surfaces 62 and 63 render it less likely that the particles of tobacco which form the partial streams 81, 82 and 83 would interfere with each other during travel (in unsupported condition) in the channel 67 and toward the conveyor 51.

It has been found that, by proper selection of the rate of flow of air into the passages 52 of the nozzle 55, by proper selection of the rate of evacuation of air from the channel 67 into the suction chamber 76, and by proper selection of the rate of air flow into the suction chamber 69, the apparatus of the present invention can produce a tobacco stream of heretofore unmatched homogeneousness. This is attributable to the establishment of initial contact between air streams and particles of tobacco well ahead of the conveyor 51 as well as to establishment of adequate contact between the streams of compressed air and all particles of tobacco which form the stream 42. Furthermore, the formation of a highly homogeneous tobacco stream is attributable to the transport of a mixture of tobacco particles and air along the arcuate path which is defined by the guide wall 41 ahead of the channel 67. As mentioned above, the accelerating and direction-determining action of the guide wall 41, in cooperation with the air streams issuing from the nozzle 55, can be so pronounced and so predictable that the carded conveyor 37 can be omitted in its entirety, i.e., the apparatus will operate properly without any mechanical tobacco accelerating means in or downstream of the source (duct 39) from which tobacco is supplied into the range of air streams in the passages 52.

FIG. 4 shows a portion of a modified apparatus wherein all such parts which are identical with or clearly analogous to the corresponding parts of the apparatus of FIGS. 1, 2, 3*a*, 3*b* and 7 to 11 are denoted by similar reference characters plus 100. The main difference between the two embodiments is that the apparatus of FIG. 4 comprises a second suction chamber 169' which is outwardly adjacent to an outwardly extending air-permeable portion or section 166' of the right-hand sidewall 166 so that the two suction chambers 169, 169' can withdraw a larger percentage of air which is supplied by the nozzle (not shown) and enters the lowermost portion of the channel 167 by flowing along the arcuate path which is defined by the concave upper side of the guide wall 141. The rate of air flow through the openings 168 and 168' of the portions or sections 164', 166' can be readily selected in such a way that the flow of some air from the channel 167 into the suction chambers 169, 169' does not influence the trajectories of particles forming the partial streams 181, 182 and even less the trajectories of particles which form the partial stream 183. The mirror symmetrical arrangement of the air-permeable portions or sections 164', 166' contributes to stabilization of the centrally located partial stream 183 as well as to stabilization of the two outer partial streams 181, 182 because air entering the suction chamber 169 is less likely to influence the particles of the partial stream 182 and air entering the suction chamber 169' is less likely to influence the particles of the partial stream 181. The actions of air streams which flow into the suction chambers 169, 169' upon the centrally located partial stream 183 of tobacco particles neutralize each other.

Figures 5A, 5B:
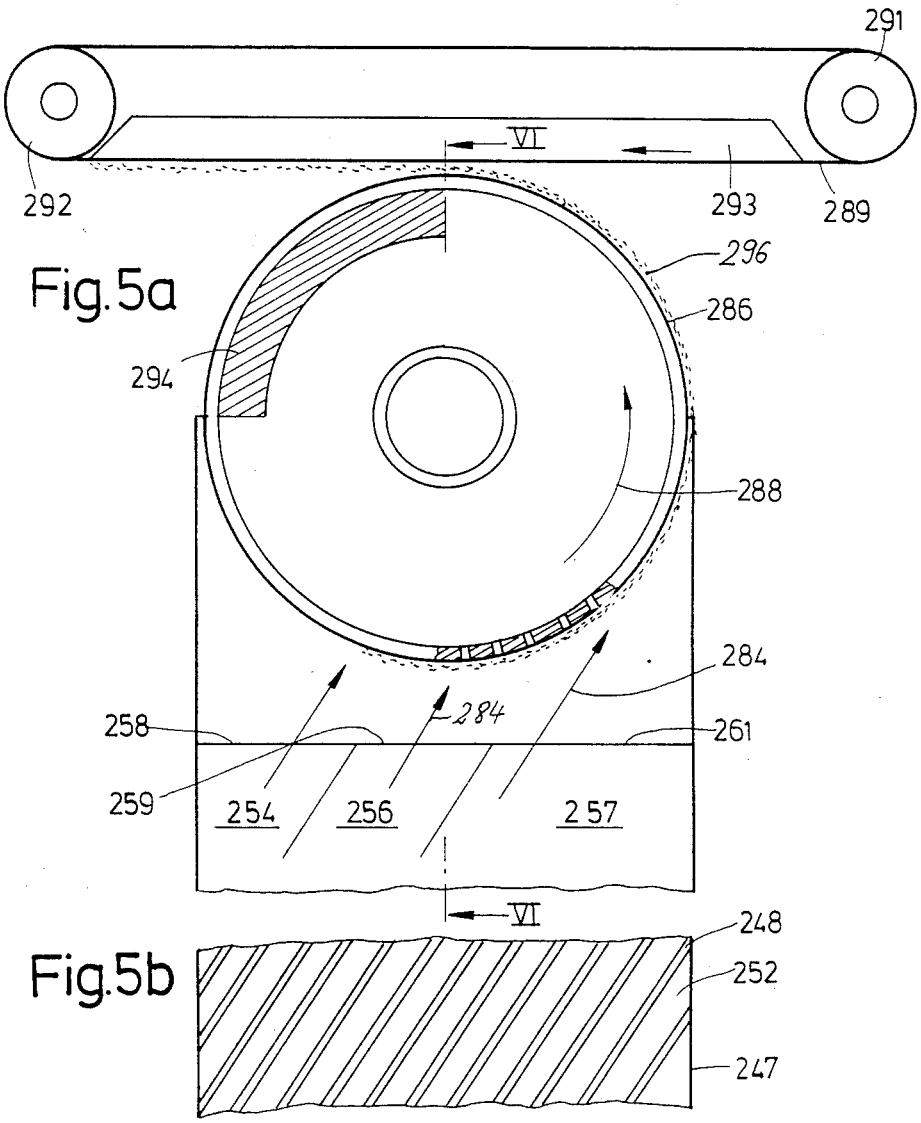
FIG. 5*a* is a fragmentary vertical sectional view of a third distributor wherein the conveyor which receives particles of tobacco to form a homogeneous stream is a disc-shaped rotary member.
FIG. 5*b* is a view similar to that of FIG. 3*b* but showing a portion of a nozzle for admission of streams of compressed air into a distributor which embodies the structure of FIG. 5*a;*
Figure 7:
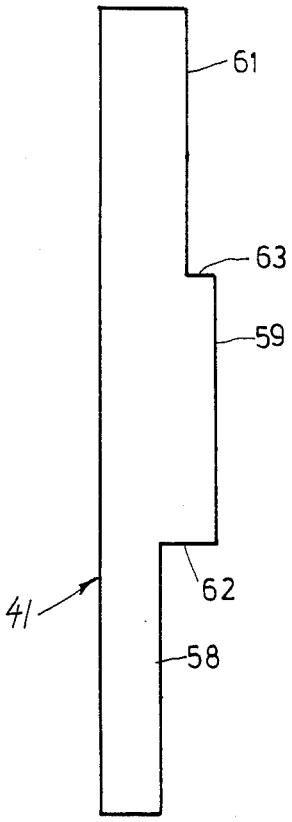
FIG. 7 is a plan view of the tobacco discharging end of tobacco supplying means in the distributor of FIG. 1, substantially as seen in the direction of arrows from the line VII—VII of FIG. 2.

FIGS. 5*a*, 5*b* and 6 illustrate a portion of a third apparatus wherein all such parts which are identical with or clearly analogous to the corresponding parts of the apparatus of FIGS. 1, 2, 3*a*, 3*b* and 7 to 11 are denoted by similar reference characters plus 200. The band-like air-permeable conveyor 51 is replaced with a disc- or wheel-shaped rotary conveyor 286 including an air-permeable circumferentially extending element or wall 273 having radially extending openings 272 communicating with a suction chamber 276 in the interior of the conveyor 286. The channel 287 is a circumferentially complete channel which surrounds the air-permeable element 273 and is flanked by two flanges 264, 266 performing the functions of the aforediscussed sidewalls 64, 66. The guide wall 241 defines an arcuate path for the admission of partial streams 281, 282, 283 of tobacco particles into the channel 287 whereby such partial streams travel first along the guide faces 254, 256, 257 and thereupon beyond the edge faces 258, 259, 261 at the outlet end of the aforementioned arcuate path. The orientation of the guide faces 254, 256, 257 is such that each stream of compressed air flowing along the arcuate path at the concave side of the guide wall 241 flows in the direction which is indicated by arrows 284, i.e., it has a component of movement in the direction of travel of the homogeneous tobacco stream which grows at and thereupon advances with the outer side of the circumferentially extending element 273 of the conveyor 286. The direction of travel of the tobacco stream with the conveyor 286 is indicated by the arrow 288.

The conveyor 286 delivers successive increments of the fully grown homogeneous tobacco stream 296 to the underside of the lower reach of an air-permeable endless belt conveyor 289 which is trained over pulleys 291, 292 and cooperates with a suction chamber 293 having an open or partially open bottom wall adjacent to the upper side of the lower reach of the conveyor 289. A stationary shroud 294 in the interior of the conveyor 286 overlies the inner ends of the openings 272 in the element 273 between the nine and twelve o'clock positions of the conveyor 286, as viewed in FIG. 5*a*, to ensure that the suction chamber 293 can readily attract successive increments of the tobacco stream 296 from the outer side of the element 273 to the underside of the lower reach of the conveyor 289. The surplus of air which the nozzle (not shown) admits into the channel 287 is permitted to excape through a narrow clearance 297 between the flange 264 and the adjacent outwardly extending upper end portion of the guide wall 241. The annular channel 287 communicates with the channel 267 which is located to the right of the uppermost portion of the guide wall 241, as viewed in FIG. 6; in fact, the annular channel 287 can be said to form part of the channel 267.

FIG. 6 further shows that the guide wall 241 need not cooperate with a carded conveyor, such as the conveyor 37 of FIG. 2.

The fact that the path which is defined by the outer side of the circumferentially extending element 273 of the conveyor 286 is an arcuate (convex) path is of no consequence insofar as the formation of a homogenized tobacco stream is concerned. Thus, the inclination of air streams flowing in the directions indicated by arrows 284 can be readily selected in such a way that the slippage of particles which impinge upon the external surface of the rotating element 273 and/or upon the tobacco particles which are already held at the external surface of such element (while the conveyor rotates in the direction of arrow 288) is nil or negligible. FIG. 5*a* shows that the particles of tobacco which advance in the directions indicated by arrows 284 (especially those advancing beyond the edge face 261) impinge substantially tangentially upon the element 273 so that they are not likely to rebound at the outer side of such element.

The distribution of openings 272 in the element 273 can be readily selected in such a way that the effect is the same as that described in connection with FIGS. 8 to 11. It is also possible to provide the element 273 with uniformly distributed openings 272 and to place at the inner side of the element 273 a stationary valving element (such as a strip having perforations distributed in a manner as shown for the openings 72 in the bottom wall 73 of FIG. 8) which ensures more pronounced and less pronounced attraction of tobacco particles to selected portions of the outer side of the element 273.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of building a tobacco stream on an air-permeable conveyor which is driven to advance the stream in a predetermined direction and cooperates with first and second sidewalls to define a channel extending in said direction and disposed at one side of the conveyor, comprising the steps of establishing a pressure differential between the one side and another side of the conveyor to thus induce the flow of air from the channel through the conveyor; establishing a source of tobacco particles; conveying streams of air into the channel and toward selected portions of the one side of the conveyor which are staggered with reference to one another, as considered transversely of and in said direction; and admitting tobacco particles from the source into the air streams so that the thus admitted particles of tobacco share the movements of the air stream and are deposited on and adhere to the selected portions of the one side of the conveyor with the attendant formation of a tobacco stream containing particles in a predetermined distribution in and transversely of said direction.

2. The method of claim 1, further comprising the step of establishing a source of compressed air, said conveying step comprising conveying streams of compressed air from the respective source along the concave side of an arcuate path and into the channel and said admitting step comprising admitting particles of tobacco into said arcuate path, and further comprising the step of subdividing the particles of tobacco in said arcuate path into several partial tobacco streams.

3. The method of claim 2, further comprising the step of establishing for the partial tobacco streams discrete trajectories for the propulsion of the respective tobacco particles by streams of compressed air across the channel and toward the selected portions of the one side of the conveyor.

4. The method of claim 3 of building a tobacco stream on a conveyor the one side of which has spaced-apart first and second marginal portions adjacent to the respective sidewalls and a central portion between the marginal portions, wherein said step of establishing discrete trajectories comprises establishing first and second trajectories for the propagation of first and second partial tobacco streams toward the respective marginal portions and a third trajectory for the propagation of a third partial tobacco stream toward the central portion of the one side of the conveyor.

5. The method of claim 3, wherein the trajectories extend at least substantially tangentially of the arcuate path.

6. The method of claim 3, wherein the step of conveying air streams from the respective source includes admitting into the channel compressed air at a rate exceeding the rate of evacuation of air through the conveyor as a result of the establishment of said pressure differential and at least one of the sidewalls has a recessed air-permeable portion adjacent to the locations of establishment of discrete trajectories, and further comprising the step of withdrawing the surplus of compressed air from the channel by way of the air-permeable portion of the one sidewall.

7. The method of claim 3, further comprising the step of imparting to the air streams in said path and to the partial tobacco streams components of movement in said predetermined direction.

8. The method of claim 3, further comprising the step of increasing the rate of air flow through those portions of the conveyor which are in the process of receiving partial streams of tobacco particles.

9. The method of claim 3, further comprising the steps of classifying tobacco particles and admitting selected fractions of classified particles into the respective source.

10. The method of claim 3, wherein said step of establishing trajectories includes propelling the partial streams upwardly and in directions at an acute angle to the vertical.

11. Apparatus for building a continuous tobacco stream, comprising a conveyor including a driven air-permeable element having first and second sides and arranged to advance the stream in a predetermined direction; suction generating means adjacent to the first side of said element; spaced-apart first and second sidewalls adjacent to the second side of and defining with said element an elongated channel extending in said direction; a source of tobacco particles; and guide means for conveying tobacco particles from said source into said channel, including a plurality of guide faces which are staggered with reference to each other, as considered transversely of and in said direction, said guide means further having edge faces remote from said element and each of said guide faces terminating at a different one of said edge faces, each of said guide faces being arranged to direct tobacco particles toward a selected portion of the second side of said element with the attendant formation of a tobacco stream containing particles in a predetermined distribution in and transversely of said direction.

12. The apparatus of claim 11, wherein said guide means defines an arcuate path which is disposed upstream of said guide faces and has a concave side, said source being arranged to admit tobacco particles into said path and further comprising a source of compressed air and means for admitting streams of compressed air from the respective source into said path so that the air streams entrain tobacco particles toward, along and beyond said guide faces for deposition on the selected portions of the second side of said element.

13. The apparatus of claim 12, wherein said guide faces are arranged to direct partial streams of tobacco particles beyond the respective edge faces and toward the selected portions of the second side of said element so that each partial stream has its own trajectory extending across said channel and terminating at the second side of said element.

14. The apparatus of claim 13, wherein said edge faces are disposed in said channel.

15. The apparatus of claim 13, wherein imaginary lines extending beyond said edge faces and tangentially of the respective guide faces intersect the respective selected portions of the second side of said element.

16. The apparatus of claim 13, wherein said element has first and second marginal portions adjacent to the respective sidewalls and a central portion between said marginal portions, said guide faces including first and second guide faces which respectively direct first and second partial tobacco streams toward the first and second marginal portions and a third guide face which directs a third partial tobacco stream toward the central portion of said element.

17. The apparatus of claim 13, wherein said tobacco supplying means further comprises transversely extending surfaces alternating with said guide faces and being inclined with reference to said predetermined direction.

18. The apparatus of claim 13, wherein said suction generating means includes a wall adjacent to the first side of said element and having groups of openings in register with said selected portions of said second side.

19. The apparatus of claim 18, wherein said suction generating means comprises a suction chamber and said wall constitutes the bottom wall of said chamber.

20. The apparatus of claim 11, wherein at least one of said sidewalls has a recessed air-permeable portion adjacent to said edge faces and further comprising means for drawing air from said channel by way of said air-permeable portion.

21. The apparatus of claim 20, wherein said means for drawing air from said channel comprises a suction chamber which is outwardly adjacent to said air-permeable portion.

22. The apparatus of claim 11, wherein said conveyor includes an endless band having an elongated stretch which constitutes said air-permeable element.

23. The apparatus of claim 11, wherein said conveyor comprises a rotary disc having a circumferentially extending wall which constitutes said air-permeable element.

* * * * *